US006691514B2

(12) United States Patent
Bushey

(10) Patent No.: US 6,691,514 B2
(45) Date of Patent: Feb. 17, 2004

(54) METHOD AND APPARATUS FOR GENERATING POWER

(76) Inventor: Richard D. Bushey, 1596 38$^{th}$ Ave., Kenosha, WI (US) 53140

( * ) Notice: Subject to any disclaimer, the term of this patent is extended or adjusted under 35 U.S.C. 154(b) by 88 days.

(21) Appl. No.: 10/128,037

(22) Filed: Apr. 23, 2002

(65) Prior Publication Data

US 2003/0196438 A1 Oct. 23, 2003

(51) Int. Cl.$^{7}$ ..... F01K 25/08
(52) U.S. Cl. ..... 60/651; 60/655; 60/671
(58) Field of Search ..... 60/649, 651, 671, 60/673, 655

(56) References Cited

U.S. PATENT DOCUMENTS

| | | | | |
|---|---|---|---|---|
| 3,704,534 | A | | 12/1972 | Bechtold |
| 3,878,683 | A | | 4/1975 | Imai |
| 3,992,891 | A | | 11/1976 | Pocrnja |
| 4,086,772 | A | | 5/1978 | Williams |
| 4,106,581 | A | | 8/1978 | West et al. |
| 4,132,077 | A | * | 1/1979 | Johnson ..... 60/649 |
| 4,226,294 | A | | 10/1980 | Latter et al. |
| 4,227,374 | A | | 10/1980 | Oxley |
| 4,281,514 | A | | 8/1981 | Egerer |
| 4,283,211 | A | | 8/1981 | Ehrlich et al. |
| 4,294,323 | A | | 10/1981 | Boese |
| 4,330,998 | A | | 5/1982 | Nozawa |
| 4,359,118 | A | * | 11/1982 | Latter et al. ..... 180/69.5 |
| 4,406,897 | A | * | 9/1983 | Campbell et al. ..... 514/245 |
| 4,429,536 | A | | 2/1984 | Nozawa |
| 4,437,308 | A | | 3/1984 | Fischer |
| 4,437,312 | A | | 3/1984 | Newton et al. |
| 4,444,015 | A | | 4/1984 | Matsumoto et al. |
| 4,467,609 | A | | 8/1984 | Loomis |
| 4,765,143 | A | | 8/1988 | Crawford et al. |
| 4,864,826 | A | | 9/1989 | Lagow |
| 4,995,234 | A | | 2/1991 | Kooy et al. |
| 5,076,837 | A | | 12/1991 | Rathbone et al. |
| 5,220,797 | A | * | 6/1993 | Krishnamurthy et al. ..... 62/620 |
| 5,370,418 | A | | 12/1994 | Pugh |
| 5,613,362 | A | | 3/1997 | Dixon |
| 5,649,425 | A | | 7/1997 | Matsumura et al. |
| 6,195,999 | B1 | | 3/2001 | Arnold et al. |
| 6,523,366 | B1 | * | 2/2003 | Bonaquist et al. ..... 62/613 |

* cited by examiner

*Primary Examiner*—Hoang Nguyen
(74) *Attorney, Agent, or Firm*—Boyle Fredrickson Newholm Stein & Gratz S.C.

(57) ABSTRACT

A method and apparatus for generating power is provided. Nitrogen gas is compressed by a compressor so as to provide liquid nitrogen of a predetermined temperature. A gaseous refrigerant is passed through the compressed nitrogen so as to condense the refrigerant. The condensed refrigerant is passed through the ambient air having a predetermined temperature such that the temperature and pressure of the refrigerant increase. The expansion of the refrigerant in a turbine drives a generator that, in turn, generates power.

27 Claims, 4 Drawing Sheets

METHOD AND APPARATUS FOR GENERATING POWER

FIELD OF THE INVENTION

This invention relates generally to power generation devices, and in particular, to a method and apparatus for generating power utilizing the thermal energy provided by the temperature differential between ambient air and liquid nitrogen.

BACKGROUND AND SUMMARY OF THE INVENTION

As is known, numerous systems have been developed to meet the constantly increasing power demands of the modern world. These systems often use combustible fossil fuels such as natural gas, oil, coal and the like. Typically, the fossils fuel is burned to generate thermal energy that, in turn, is converted to mechanical energy. While fossil fuel systems are functional for their intended purpose, these types of systems have two inherent problems. First, the burning of fossil fuels may produce environmentally unfriendly by-products. Second, the supplies of the fossil fuels used in these systems are slowly becoming depleted. Consequently, it has become necessary to develop alternative sources of energy.

In order to overcome the inherent problems associated with the use of fossil fuels, various alternative-energy systems have been developed. For example, solar energy systems and systems utilizing wind power are presently in use. However, these systems also have certain limitations associated with their use. By way of example, these systems often require large energy-gathering structures such as windmills and solar panels in order for the systems to generate sufficient energy for products that have high power demands. Hence, given the size requirements, present use of such alternative-energy systems for such products as vehicles is impractical.

In addition, other types of systems have been developed that convert heat energy into mechanical energy by circulating a liquefied gas in a closed cycle. In most of these types of systems, the liquefied gas is subjected to a heat exchange with heat energy of another substance during circulation of the liquefied gas. Once again, while liquefied gas systems are functional for their intended purpose, these systems are complicated and require specialized equipment in order for the systems to function properly. By way of example, Imai, U.S. Pat. No. 3,878,683 discloses a method for power generation. The method includes the steps of disposing a liquefied gas in a closed container at a temperature and pressure less than the critical temperature and pressure of the gas. The liquefied gas is heated to the critical temperature and above the critical pressure. The pressure of the gas is regulated to a specified value greater that the critical pressure, but less than a pressure which would be detrimental to the equipment utilized. The gas is subjected to a heat exchange with another medium thereby heating the gas and cooling the medium. The gas expands to a predetermined pressure, and thereafter, valves open to allow the gas to flow into a high-pressure tank wherein the pressure of the gas is regulated. When the pressure of the gas exceeds a predetermined threshold, a valve on the high-pressure tank is opened and the gas flows to a means such as turbine that transforms the expansion of the gas into mechanical energy and that reduces the temperature of the gas below the critical temperature. It is contemplated that a portion of the power generated is used to effect the flow of all of the fluids in the system. Thereafter, the gas is liquefied and returned to the closed container. It can be appreciated that the complexity of the apparatus disclosed in the Imai '683 patent renders the device impractical for most applications. As such, a power generation system that may be used in a wide variety of applications is highly desirable.

Therefore, it is a primary object and feature of the present invention to provide a method and apparatus for generating power that is simpler and less expensive than prior power generation systems.

It is a further object and feature of the present invention to provide a method and apparatus for generating power that utilizes the thermal energy provided by the temperature differential between ambient air and liquid nitrogen.

It is a still further object and feature of the present invention to provide a method and apparatus for generating power that eliminates or severely limits the need for using fossil fuels, as required by prior power generation systems.

In accordance with the present invention, a method is provided for generating power. The method includes the steps of passing a gaseous refrigerant through a pool of compressed nitrogen such that the refrigerant is condensed and pumping the condensed refrigerant through an evaporator. Ambient air is passed over the evaporator so as to increase the temperature and increase the pressure of the refrigerant. The refrigerant is allowed to expand and to drive a power generation device. Thereafter, the refrigerant is passed once again through the pool of liquid nitrogen in order to be condensed. The condensed refrigerant is pumped through the evaporator and the process is repeated.

It is contemplated to compress the nitrogen with a compressor prior to passing refrigerant through the pool and to use the compressed nitrogen to form the pool. The compressor is positioned between the evaporator and a fan which generates a flow of ambient air. The ambient air is urged over the compressor by the fan prior to the ambient air being passed over the evaporator. It is contemplated that the nitrogen provided to the compressor is recovered from the ambient air. Alternatively, the compressed nitrogen may be allowed to expand after the refrigerant has passed through the pool. The expanded nitrogen is returned to the compressor to be compressed or released into the ambient air. The pool of compressed nitrogen is stored in a tank having a check valve. The check valve allows the compressed nitrogen to expand and to be discharged from the tank after the refrigerant passes through the pool.

The power generation device includes a turbine and an electrical generator operatively connected thereto. The refrigerant expands and rotates the turbine in order to drive the electrical generator. The electrical generator, in turn, generates electrical energy.

In accordance with a further aspect of the present invention, a method is provided for generating power. The method includes the steps of capturing nitrogen from ambient air and compressing the nitrogen with a compressor such that the nitrogen has a predetermined temperature. A gaseous refrigerant is passed through the compressed nitrogen so as to be condensed. The condensed refrigerant is passed through the ambient air having a predetermined temperature such that the temperature and pressure of the refrigerant increases. Power is generated by expansion of the refrigerant in response the difference between the predetermined temperature of the nitrogen and the predetermined temperature of the ambient air.

The step of passing the refrigerant through the ambient air may include the additional steps of pumping the condensed refrigerant through an evaporator and passing ambient air over the evaporator so as to increase the temperature and increase the pressure of the refrigerant. The step of generating power with the refrigerant may include the additional steps of providing a power generation device including a turbine and electrical generator operatively connected thereto and passing the refrigerant therethrough so as to rotate the turbine and drive the electrical generator.

A fan may be provided for generating a flow of ambient air. The compressor is positioned between the fan and the evaporator such that the fan urges the ambient air over the compressor prior to such ambient air passing over the evaporator. It is contemplated to allow the compressed nitrogen to expand after the refrigerant passed therethrough and to return the expanded nitrogen to the compressor to be recompressed. Alternatively, the expanded nitrogen may be discharged into the ambient air.

In accordance with a still further aspect of the present invention, an apparatus is provided for generating power utilizing a refrigerant. The apparatus includes a tank having an interior. A pool of liquid nitrogen is provided within the interior of the tank. The liquid nitrogen has a predetermined temperature. A condenser is disposed in the pool of nitrogen in a tank for condensing gaseous refrigerant flowing therethrough. The condenser has an input and an output. An evaporator coil is disposed in the ambient air for increasing the temperature and the pressure of the condensed refrigerant. The evaporator coil also has an input and output. A pump interconnects the output of the condenser and the input of the evaporator coil. The pump pumps the condenser refrigerant from the condenser to the evaporator coil. A power generation unit interconnects the output of the evaporator and the input of the condenser. The power generation unit generates power in response to expansion of refrigerant flowing therethrough.

It can be appreciated that the condenser effectuates a heat exchange between the refrigerant flowing therethrough and the pool of nitrogen. The evaporator coil effectuates a heat exchange between the refrigerant and the ambient air. In order to facilitate the heat exchange between the refrigerant and the ambient air, a fan is provided for urging the ambient air over the evaporator coil. A compressor may be disposed between the fan and the evaporator coil for compressing nitrogen and providing the same to the interior of the tank of the liquid nitrogen. A nitrogen device may be provided for drawing nitrogen from the ambient air and supplying the nitrogen to the compressor.

The apparatus may also include the check valve operatively connected to the tank. The check valve allows the liquid nitrogen of the pool of the liquid nitrogen to expand and exit the interior of the tank therethrough. A conduit operatively connects the check valve and the compressor to return the expanded nitrogen to the compressor to be recompressed.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings.

DETAILED DESCRIPTION OF THE INVENTION

Figure 1:
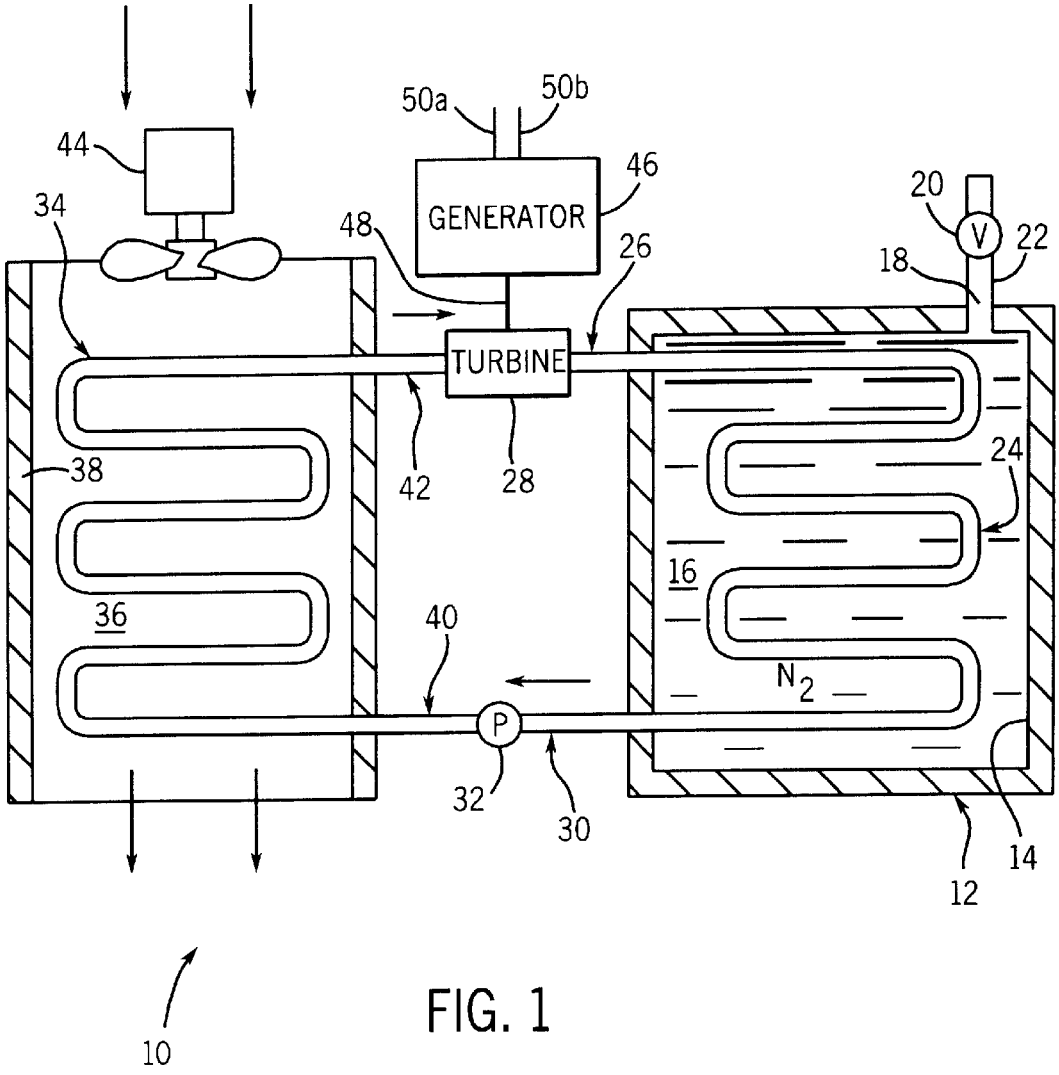
FIG. 1 is a schematic view of a first embodiment of a power generation apparatus in accordance with the present invention.

Referring to FIG. 1, a power generation apparatus in accordance with the present invention is generally designated by the reference numeral 10. Power generation apparatus 10 includes a tank 12 having an inner surface 14 defining interior 16 thereof. It is intended that interior 16 of tank 12 be filled with liquid nitrogen ($N_2$) for reasons hereinafter described. As such, tank 12 must be of sufficient strength to maintain its integrity when subjected to the pressures of the liquid nitrogen stored therein. In addition, tank 12 must be insulated to reduce the possibility of a heat exchange between the liquid nitrogen stored within tank 12 and the external environment.

Tank 12 is provided with an exhaust port 18 therein. Exhaust port 18 of tank 12 communicates with check valve 20 through conduit 22. It is intended that check valve 20 open in response to a predetermined pressure within tank 12, for reasons hereinafter described. Condenser 24 extends through tank 12 and includes an input end 26 operatively connected to turbine 28, for reasons hereinafter described, and an output end 30 operatively connected to pump 32, for reasons hereinafter described. Evaporator coil 34 is positioned within interior 36 of air flow conduit 38. Evaporator coil 34 includes an input end 40 operatively connected to pump 32, for reasons hereinafter described, and an output end 42 operatively connected to turbine 28, for reasons hereinafter described. It is intended that a refrigerant having a low boiling point, such as gaseous ammonia, freon or propane, flow between and through condenser 24 and evaporator coil 34. It can appreciated that other types of refrigerant may be used without deviating from the scope of the present invention.

In operation, a refrigerant in a gaseous state is provided at input end 26 of condenser 24. The gaseous refrigerant passes through condenser 24 within interior 16 of tank 12 such that a heat exchange is effectuated between the liquid nitrogen within interior 16 of tank 12 and the refrigerant flowing through condenser 24. In response to such heat exchange, the refrigerant flowing through condenser 24 is cooled and condenses thereby providing a low temperature liquid refrigerant at output end 30 of condenser 24.

The liquid refrigerant provided at output end 30 of condenser 24 is pumped by pump 32 into the input end 40 of evaporator coil 34 and flows therethrough. Fan 44 urges ambient air through interior 36 of air flow conduit 38 such that the ambient air passes over evaporator coil 34. A heat exchange is effectuated between the refrigerant flowing through evaporator coil 34 and the ambient air passing through the interior 36 of air flow conduit 38 such that the temperature of the refrigerant flowing through evaporator coil 36 increases to the refrigerant's boiling point. Consequently, the refrigerant flowing through evaporator coil 34 changes from a liquid to a gaseous state as the refrigerant approaches output end 42 of evaporator coil 34. Since the volume of evaporator coil 34 is fixed, the pressure of the gaseous refrigerant flowing therethrough increases. The high temperature, high pressure gaseous refrigerant is provided at the input of a conventional turbine 28. Expansion of the high temperature, high pressure gaseous refrigerant rotate turbine 28. It is contemplated that turbine 28 be operatively connected to a power generation device, e.g. electrical generator 46, by drive shaft 48 such that rotation of turbine 28 rotates drive shaft 48 that, in turn, drives electrical generator 46. In response thereto, electrical generator 46 generates electrical power on lines 50*a* and 50*b*.

Once the gaseous refrigerant passes through turbine 28, the pressure of the gaseous refrigerant is dissipated such that a high temperature, low pressure gaseous refrigerant is provided at input end 26 of condenser 24 and the process is repeated. As described, it can be appreciated that power generation apparatus 10 of the present invention may continuously generate electrical power at lines 50*a* and 50*b*.

In order to convert the high temperature, low pressure gaseous refrigerant provided at input end 26 of condenser 24 into a low temperature, low pressure liquid refrigerant at output end 30 of condenser 24, a heat exchange is effectuated between the refrigerant flowing through condenser 24 and the liquid nitrogen within interior 16 of tank 12. Consequently, the temperature of the liquid nitrogen within interior 16 of tank 12 will slowly rise such that the liquid nitrogen will eventually boil and change to a gaseous state. Given the volume of interior 16 of tank 12 remains constant, the pressure within interior 16 of tank 12 will increase. In response to the pressure within interior 16 of tank 12 exceeding a predetermined pressure, check valve 20 opens thereby allowing nitrogen gas to pass therethrough out of interior 16 of tank 12. Hence, in order for power generation system 10 to function continuously, the liquid nitrogen within interior 16 of tank 12 must be replenished from time.

Figure 2:
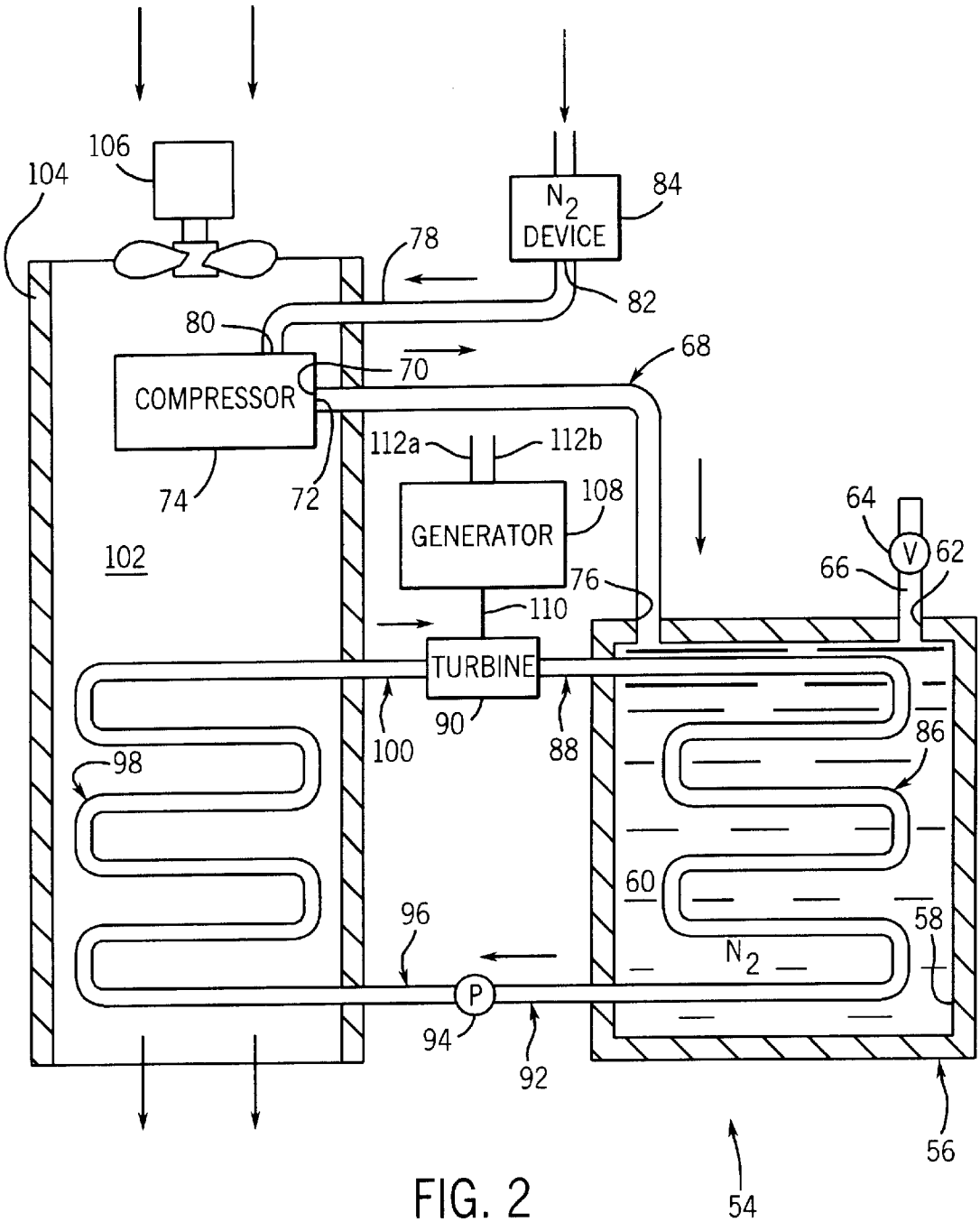
FIG. 2 is a schematic view of a second embodiment of the power generation apparatus of the present invention.

Referring to FIG. 2, an alternate embodiment of a power generation apparatus in accordance with the present invention is generally designated by the reference numeral 54. Power generation apparatus 54 includes tank 56 having an inner surface 58 defining an interior 60 for receiving liquid nitrogen ($N_2$). As such, tank 56 must be of sufficient strength to maintain its integrity when subjected to the pressures of the liquid nitrogen stored therein. In addition, tank 56 must be insulated to reduce the possibility of a heat exchange between the liquid nitrogen stored within tank 56 and the external environment.

Tank 56 is provided with an exhaust port 62 therein. Exhaust port 62 of tank 56 communicates with check valve 64 through conduit 66. It is intended that check valve 64 open in response to a predetermined pressure within tank 56. Compressor conduit 68 includes an input 70 operatively connected to the output 72 of a compressor 74 and an output 76 communicating with the interior 60 of tank 56. It is contemplated that compressor 74 provide liquid nitrogen to interior 60 of tank 56 so as to maintain a predetermined volume of liquid nitrogen within interior 60 of tank 56. Nitrogen conduit 78 interconnects input 80 of compressor 74 to the output 82 of a nitrogen device 84. Nitrogen device 84 draws ambient air therein and separates nitrogen gas therefrom. The nitrogen gas separated from the ambient air by nitrogen device 84 is provided through nitrogen conduit 78 to compressor 74 which, in turn, compresses the nitrogen gas to form liquid nitrogen. The liquid nitrogen generated by compressor 74 is provided to the interior 60 of tank 56 through compressor conduit 68, for reasons heretofore described.

Condenser 86 extends through tank 56 and includes an input end 88 operatively connected to turbine 90 and an output end 92 operatively connected to pump 94. Pump 94 interconnects output end 92 of condenser 86 to input end 96 of evaporator coil 98. Turbine 90 interconnects output end 100 of evaporator coil 98 to input end 88 of condenser 24. Evaporator coil 98 is positioned within interior 102 of air flow conduit 104, for reasons hereinafter described.

In operation, ambient air is drawn into the nitrogen device 84 and provided to compressor 74, as heretofore described. Compressor 74 compresses the nitrogen gas and provides the same to the interior 60 of tank 56 through compressor conduit 68. A gaseous refrigerant having a low boiling point, such as gaseous ammonia, freon or propane, is provided at input end 88 of condenser 86. A head exchange is effectuated between the gaseous refrigerant flowing through condenser 86 and the liquid nitrogen within interior 60 of tank 56. In response to such heat exchange, the refrigerant flowing through condenser 86 cools and condenses thereby providing a low temperature liquid refrigerant at output end 92 of condenser 86.

The low temperature, liquid refrigerant provided at output end 92 of condenser 86 is pumped by pump 94 into evaporator coil 98 through input end 96 thereof. Fan 106 urges ambient air over compressor 74 positioned within interior 102 of air flow conduit 104 so as to capture the heat dissipated thereby during the compression of the nitrogen gas. Thereafter, the ambient air flows through interior 102 of air flow conduit 104 over evaporator coil 98 so as to effectuate a heat exchange between the ambient air and the refrigerant flowing through evaporator coil 98. As the refrigerant flows from input end 96 of evaporator coil 98 to output end 100 of evaporator coil 98, the temperature of the refrigerant increases to such point that the refrigerant boils and takes on a gaseous state. Since the volume of evaporator coil 98 is constant, the pressure of the gaseous refrigerant at output end 100 of evaporator coil 98 also increases with the temperature.

The high temperature, high pressure gaseous refrigerant at output end 100 of evaporator coil 98 expands and rotates turbine 90. Turbine 90 is operatively connected to a generator, e.g. electrical generator 108, by drive shaft 110 such that rotation of turbine 90 causes drive shaft 110 to drive electrical generator 108. As is conventional, electrical generator 108 generates electrical power at lines 112*a* and 112*b*.

Turbine 90 dissipates the pressure of the gaseous refrigerant flowing therethrough such that a high temperature, low pressure gaseous refrigerant is provided at input end 88 of condenser 86. The gaseous refrigerant provided at input end 88 flows through condenser 86 and the process is repeated as heretofore described. It can be appreciated that the refrigerant flowing through condenser 86 effectuates a heat exchange with the liquid nitrogen within interior 60 of tank 56 such that the temperature of the liquid nitrogen increases to its boiling point. Upon reaching its boiling point, the liquid nitrogen changes from a liquid to a gaseous state. Since the volume of interior 60 of tank 56 is constant, the conversion of the liquid nitrogen to a gaseous state increases the pressure within interior 60 of tank 56. If the pressure within interior 60 of tank 56 exceeds a predetermined threshold, check valve 64 opens and the gaseous nitrogen is allowed to flow through exhaust port 62 in tank 56 and through check valve 64 back into the ambient air from which it was originally drawn by nitrogen device 84.

Figure 3:
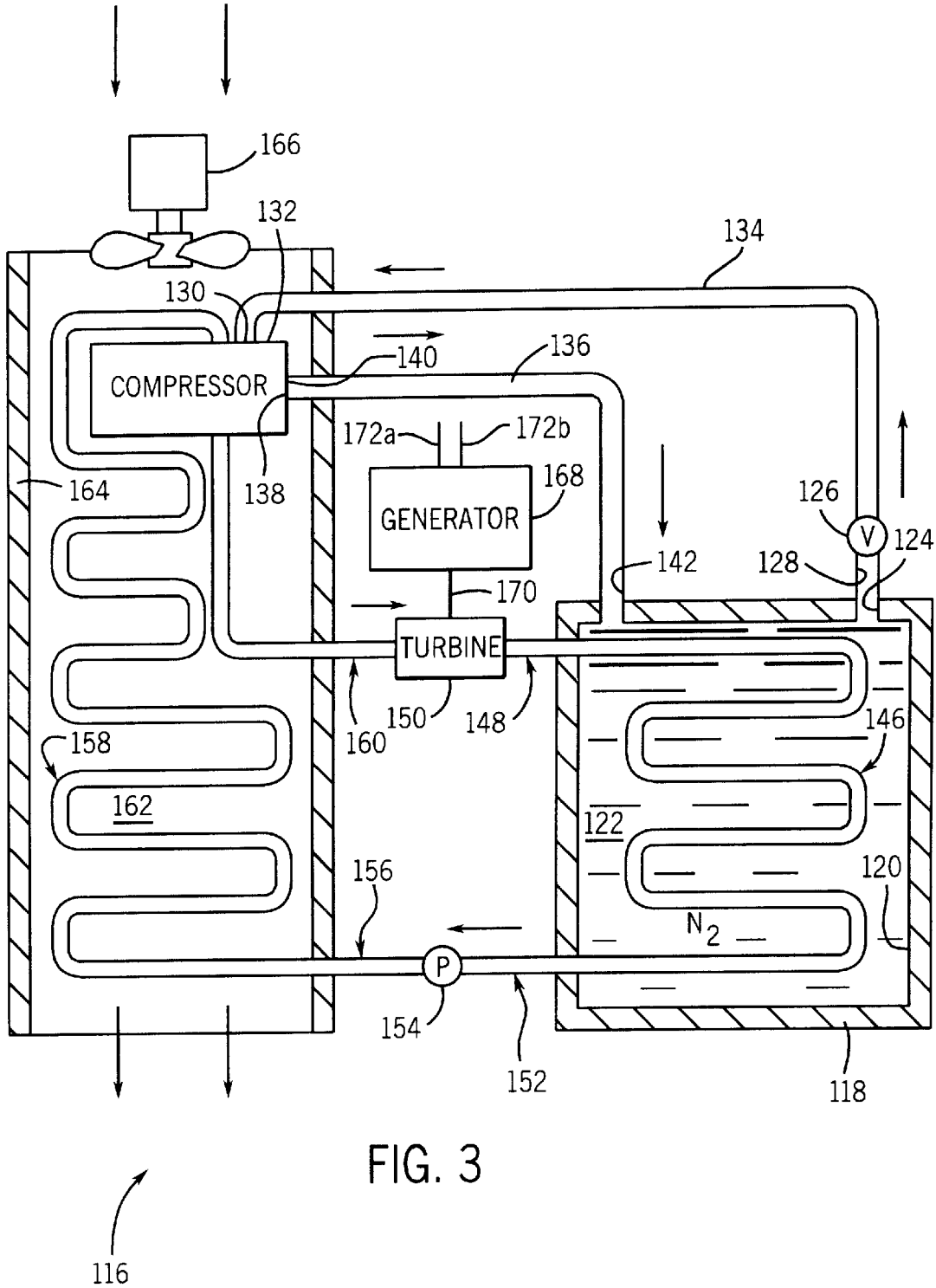
FIG. 3 is a schematic view of a third embodiment of the power generation apparatus of the present invention.

Referring to FIG. 3, a third embodiment of a power generation apparatus in accordance with the present invention is generally designated by reference numeral 116. Power generation apparatus 116 includes a tank 118 having an inner surface 120 defining an interior 122 for receiving liquid nitrogen ($N_2$). As such, tank 118 must be of sufficient strength to maintain its integrity when subjected to the pressures of the liquid nitrogen stored therein. In addition, tank 118 must be insulated to reduce the possibility to reduce the heat exchange between the liquid nitrogen stored within tank 118 and the external environment.

Tank 118 is provided with an exhaust port 124 therein. Exhaust port 124 of tank 118 communicates with check valve 126 through conduit 128. Check valve 126 further communicates with input 130 of compressor 132 through nitrogen conduit 134 for reasons hereinafter described. It is intended that check valve 126 open in response to a predetermined pressure within tank 118. Compressor conduit 136 includes an input 138 operatively connected to output 140 of compressor 132 and an output 142 communicating with interior 122 of tank 118. It is intended that nitrogen gas be provided to the input 130 of compressor 132. Thereafter, compressor 132 compresses the nitrogen gas to form liquid nitrogen which is provided at output end 138 thereof. The liquid nitrogen is transferred to interior 122 of tank 118 through compressor conduit 136.

Condenser 146 extends through tank 118 and includes an input end 148 operatively connected to turbine 150 and an output end 152 operatively connected to pump 154. Pump 154 interconnects output end 152 of condenser 146 to input end 156 of evaporator coil 158. Turbine 150 interconnects output end 160 of evaporator coil 158 to input end 148 of condenser 146. Evaporator coil 158 is positioned within interior 162 of air flow conduit 164 and wraps about the outer periphery of compressor 132, for reasons hereinafter described.

In operation, nitrogen gas is provided at input 130 of compressor 132. Compressor 132 compresses the nitrogen gas and provides the same to the interior 122 of tank 118 through compressor conduit 136. A gaseous refrigerant having a low boiling point, such as gaseous ammonia, freon or propane, is provided at input end 148 of condenser 146. A heat exchange is effectuated between the gaseous refrigerant flowing through condenser 146 and the liquid nitrogen within interior 122 of tank 118. In response to such heat exchange, the refrigerant flowing through condenser 146 cools and condenses thereby providing a low temperature, liquid refrigerant at output end 152 of condenser 146.

The low temperature, liquid refrigerant provided at output end 152 of condenser 146 is pumped by pump 154 into evaporator coil 158 through input end 156 thereof. Fan 166 urges ambient air over compressor 132 positioned within interior 162 of air flow conduit 164 so as to absorb the heat dissipated by compressor 132 during compression of the nitrogen gas. Thereafter, the ambient air flows through interior 162 of air flow conduit 164 over evaporator coil 158 so as to effectuate the heat exchange between the ambient air and the refrigerant flowing through the evaporator coil 158. In addition, the portion of evaporator coil 158 wrapped about compressor 132 absorbs further heat dissipated by compressor 132.

For the reasons heretofore described, as the refrigerant flows through the input end 156 of evaporator coil 158 to output end 160 of evaporator coil 158, the temperature of the refrigerant increases. Once the temperature of the refrigerant reaches its boiling point, the refrigerant changes from a liquid state to a gaseous state. Since the volume of evaporator coil 158 is constant, the pressure of the gaseous refrigerant at output end 160 of evaporator coil 158 also increases with the temperature.

The high temperature, high pressure gaseous refrigerant at output end 160 of evaporator coil 158 extends and rotates turbine 150. Turbine 150 is operatively connected to a generator, e.g. electrical generator 168, by drive shaft 170 such that rotation of turbine 150 causes drive shaft 170 to drive electrical generator 168. As is conventional, electrical generator 168 generates electrical power at lines 172*a* and 172*b*.

Turbine 150 dissipates the pressure of the gaseous refrigerant flowing therethrough such that the high temperature, low pressure gaseous refrigerant is provided at input end 148 of condenser 146. The gaseous refrigerant provided at input end 148 flows through condenser 146 and the process is repeated as heretofore described. It can be appreciated that the refrigerant flowing through the condenser 146 effectuates a heat exchange with the liquid nitrogen within interior 122 of tank 118 such that the temperature of the liquid nitrogen increases to its boiling point. Upon reaching its boiling point, the liquid nitrogen changes from a liquid state to a gaseous state. Since the volume of interior 122 of tank 118 is constant, the conversion of the liquid nitrogen to the gaseous state increases the pressure within interior 122 of tank 118. When the pressure within interior 122 of tank 118 exceeds a predetermined threshold, check valve 126 opens and the gaseous nitrogen is allowed to enter nitrogen conduit 134. As heretofore described, the nitrogen gas within nitrogen conduit 134 is provided to input 130 of compressor 132 and the process is repeated such that the volume and temperature of the liquid nitrogen within interior 122 of tank 118 is maintained.

Figure 4:
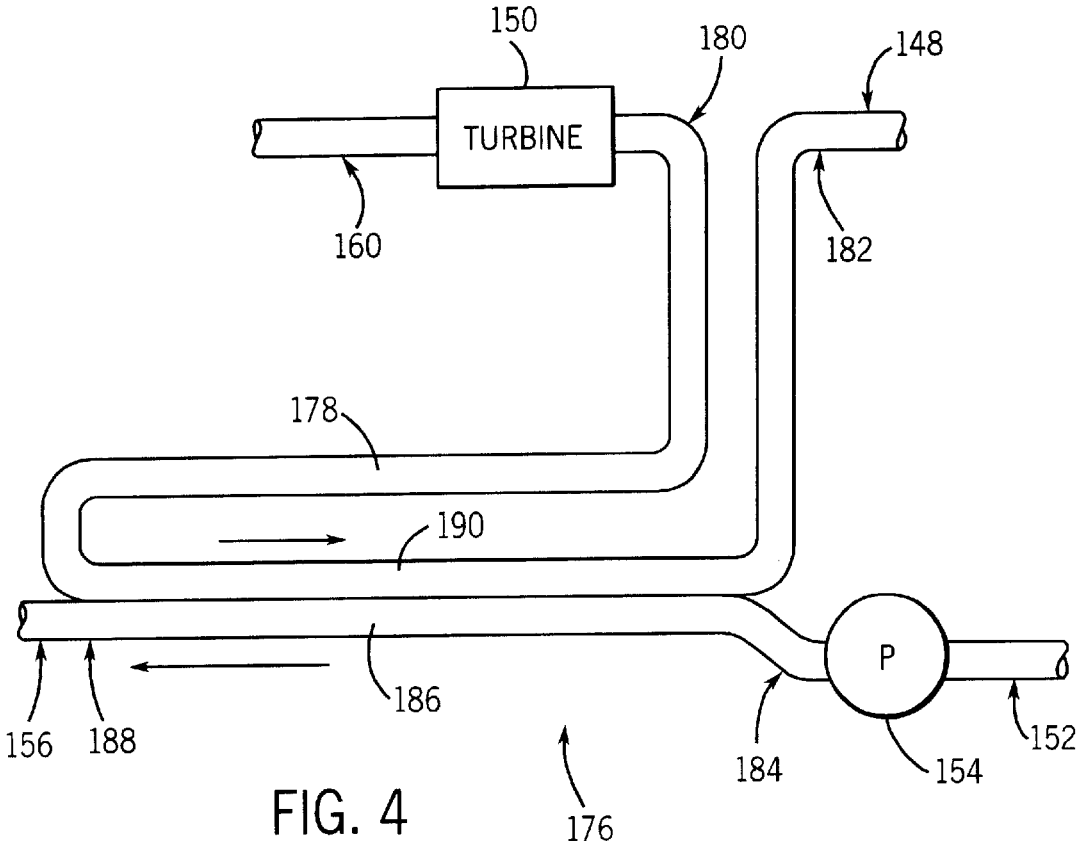
FIG. 4 is a schematic view showing an alternate construction of a portion of the power generation apparatus of FIG. 3.

Referring to FIG. 4, an alternate construction of a portion of power generation apparatus 116 is generally designated by the reference numeral 176. It can be appreciated that alternate construction 176 may be used in conjunction with power generation apparatuses 10 and 54 without deviating from the scope of the present invention. As such, the following description of alternate construction 176 used in conjunction with power generation apparatus 116 can be understood to describe use of alternate construction 176 in conjunction with power generation apparatuses 10 and 54 as if fully described hereinafter.

Alternate construction 176 includes conduit 178 having an input end 180 operatively connected to the output of turbine 150 and an output end 182 operatively connected to input end 148 of condenser 146. Pump 154 interconnects output end 152 of condenser 146 to input end 184 of conduit 186. Output end 188 of conduit 186 is interconnected to input end 156 of evaporator coil 158. It is contemplated to position a portion 190 of conduit 178 adjacent conduit 186, for reasons hereinafter described.

In operation, the high temperature, low pressure gaseous refrigerant provided at the output end of turbine 150 flows into conduit 178 through input end 180. The refrigerant flows through the output end 182 of conduit 178 into input end 148 of condenser 146. As heretofore described, a heat exchange is effectuated between the gaseous refrigerant flowing through condenser 146 and the liquid nitrogen within interior 122 of tank 118. In response to such heat exchange, the refrigerant flowing through condenser 146 cools and condenses thereby providing a low temperature, liquid refrigerant at output end 152 of condenser 146.

The low temperature, liquid refrigerant provided at output end 152 of condenser 146 is pumped through conduit 186 by pump 154 into input end 156 of evaporator coil 158. It is contemplated that a heat exchange be effectuated between the high temperature, low pressure gaseous refrigerant flowing through portion 190 of conduit 178 and the low temperature, liquid refrigerant flowing though conduit 186.

In response to such heat exchange, it can be appreciated that the refrigerant provided at input end 148 of condenser 146 is cooler than if the refrigerant was provided directly to input end 148 of condenser 146 from the output of turbine 150. In addition, the refrigerant provided at input end 156 of evaporator coil 158 is of a higher temperature than if the refrigerant was provided directly to input end 156 of evaporator coil 158 from the output of pump 154. As a result, the preheating of the refrigerant prior to entering the evaporator coil 158 and the cooling of the refrigerant prior to entering the condenser 146 increases the overall efficiency of power generation apparatus 176.

Various modes of carrying out the invention are contemplated as being within the scope of the following claims particularly pointing and distinctly claiming the subject matter, which is regarded as the invention.

I claim:

1. A method of generating power, comprising the steps of:

passing a gaseous refrigerant through a pool of compressed nitrogen such that the refrigerant is condensed;

pumping the condensed refrigerant through an evaporator;

passing ambient air over the evaporator so as to increase the temperature and the pressure of the condensed refrigerant;

driving a power generation device in response to expansion of refrigerant;

passing the expanded refrigerant through the pool of liquid nitrogen such that the expanded refrigerant is condensed; and returning to the step of pumping the condensed refrigerant through the evaporator.

2. The method of claim 1 further comprising the additional steps of:

compressing the nitrogen with a compressor prior to passing the refrigerant through the pool; and using the compressed nitrogen to form the pool.

3. The method of claim 2 further comprising the additional steps of:

providing a fan to generating a flow of ambient air;

positioning the compressor between the fan and the evaporator; and urging the ambient air over the compressor with the fan prior to passing the ambient air over the evaporator.

4. The method of claim 2 further comprising the additional steps of:

recovering nitrogen from the ambient air; and providing the nitrogen to the compressor.

5. The method of claim 1 further comprising the additional steps of:

allowing the compressed nitrogen to expand after the refrigerant is passed through the pool; and discharging the expanded nitrogen to the ambient air.

6. The method of claim 1 further comprising the steps of:

compressing the nitrogen with a compressor prior to passing the refrigerant through the pool;

allowing the compressed nitrogen to expand after the refrigerant is passed through the pool; and returning the expanded nitrogen to the compressor to be compressed.

7. The method of claim 1 wherein the power generation device includes a turbine and an electrical generator operatively connected thereto, the refrigerant expanding so as to rotate the turbine that drives the electrical generator.

8. The method of claim 1 wherein the step of passing ambient air over the evaporator includes the step of rotating a fan to urge the ambient air over the evaporator.

9. The method of claim 1 further comprising the additional step of storing the pool of compressed nitrogen in a tank, the tank having a check valve for allowing the compressed nitrogen to expand and to be discharged from the tank after the refrigerant is passed through the pool.

10. The method of claim 1 comprising the additional step of effectuating a heat exchange between the expanded refrigerant and the condensed refrigerant.

11. A method of generating power, comprising the steps:

capturing nitrogen from ambient air;

compressing the nitrogen with a compressor such that the nitrogen has a predetermined temperature;

passing a gaseous refrigerant through the compressed nitrogen so as to condense the refrigerant;

passing the condensed refrigerant through the ambient air having a predetermined temperature such that the temperature and pressure of the refrigerant increases; and generating power in response to expansion of the refrigerant.

12. The method of claim 11 wherein the step of passing the refrigerant through the ambient air includes the additional steps of:

pumping the condensed refrigerant through an evaporator; and passing ambient air over the evaporator so as to increase the temperature and pressure of the condensed refrigerant.

13. The method of claim 12 wherein the step of generating power includes the additional steps of:

providing a power generation device including a turbine and an electrical generator operatively connected thereto; and passing the refrigerant through the turbine such that refrigerant expands and rotates the turbine to drive the electrical generator.

14. The method of claim 12 further comprising the additional steps of:

providing a fan for generating a flow of ambient air;

positioning the compressor between the fan and the evaporator; and urging the ambient air over the compressor with the fan prior to passing the ambient air over the evaporator.

15. The method of claim 12 wherein the step of passing ambient air over the evaporator includes the step of rotating a fan to urge the ambient air over the evaporator.

16. The method of claim 11 further comprising the additional steps of:

allowing the compressed nitrogen to expand after the refrigerant is passed through the compressed nitrogen; and returning the expanded nitrogen to the compressor to be recompressed.

17. The method of claim 11 further comprising the additional steps of:

allowing the compressed nitrogen to expand after the refrigerant is passed through the compressed nitrogen; and discharging the expanded nitrogen to the ambient air.

18. The method of claim 11 wherein the step of generating power includes the additional steps of:

providing a turbine and passing the refrigerant through the turbine such that refrigerant expands; and effectuating a heat exchange between the expanded refrigerant and the condensed refrigerant.

19. An apparatus for generating power utilizing a refrigerant, comprising:

a tank having an interior;

a pool of liquid nitrogen within the interior of the tank, the liquid nitrogen having a predetermined temperature;

a condenser disposed in the pool of liquid nitrogen in the tank for condensing the refrigerant flowing therethrough, the condenser having an input and an output;

an evaporator coil disposed in ambient air having a predetermined temperature for expanding the condensed refrigerant, the evaporator coil having an input and an output;

a pump operatively connecting the output of the condenser and the input of the evaporator coil, the pump pumping the condensed refrigerant from the condenser to the evaporator coil; and a power generation unit operatively connecting the output of the evaporator and the input of the condenser, the power generation unit generating power in response to expansion of the refrigerant flowing therethrough.

20. The apparatus of claim 19 wherein the condenser effectuates a heat exchange between the refrigerant flowing therethrough and the pool of liquid nitrogen.

21. The apparatus of claim 19 wherein the evaporator coil effectuates a heat exchange between the refrigerant and the ambient air.

22. The apparatus of claim 19 wherein the tank includes a check valve, the check valve allowing the liquid nitrogen of the pool of liquid nitrogen to expand and exit the interior of the tank therethrough into the ambient air.

23. The apparatus of claim 19 further comprising a fan for urging ambient air over the evaporator coil.

24. The apparatus of claim 22 further comprising a compressor disposed between the fan and the evaporator coil for compressing nitrogen and providing the same to the interior of the tank as the liquid nitrogen.

25. The apparatus of claim 23 further comprising a nitrogen device for drawing nitrogen from the ambient air and supplying the nitrogen to the compressor.

26. The apparatus of claim 23 further comprising:

a check valve operatively connected to the tank, the check valve allowing the liquid nitrogen of the pool of liquid nitrogen to expand and exit the interior of the tank therethrough; and a conduit operatively connecting the check valve and the compressor to return the expanded nitrogen to compressor to be recompressed.

27. The apparatus of claim 19 wherein the power generation unit and the pump include corresponding outputs and wherein the apparatus further comprises:

a first conduit interconnecting the output of the power generation unit and the input of the condenser; and a second conduit interconnecting the output of the pump and the input of the evaporator coil, the second conduit being positioned adjacent the first conduit such that a heat exchange is effectuated therebetween.

* * * * *